US008720606B2

(12) United States Patent
Mildren et al.

(10) Patent No.: US 8,720,606 B2
(45) Date of Patent: May 13, 2014

(54) LOCKING MECHANISM FOR A GROUND DRILL

(75) Inventors: David Mildren, High Springs, FL (US); Cameron Westwood, Lesmurdie (AU)

(73) Assignee: Sandvik Intellectual Property AB, Sandviken (SE)

( * ) Notice: Subject to any disclaimer, the term of this patent is extended or adjusted under 35 U.S.C. 154(b) by 616 days.

(21) Appl. No.: 12/919,377

(22) PCT Filed: Feb. 17, 2009

(86) PCT No.: PCT/SE2009/050163

§ 371 (c)(1),
(2), (4) Date: Jan. 5, 2011

(87) PCT Pub. No.: WO2009/108113

PCT Pub. Date: Sep. 3, 2009

(65) Prior Publication Data

US 2011/0100719 A1 May 5, 2011

(30) Foreign Application Priority Data

Feb. 26, 2008 (SE) ..... 0800446

(51) Int. Cl.
*E21B 25/02* (2006.01)

(52) U.S. Cl.
USPC ..... 175/246; 175/257

(58) Field of Classification Search
USPC ..... 175/290, 257, 260, 261, 309, 246, 247, 175/254
See application file for complete search history.

(56) References Cited

U.S. PATENT DOCUMENTS

| | | | | |
|---|---|---|---|---|
| 1,058,013 | A * | 4/1913 | O'Brien | 175/260 |
| 1,671,136 | A * | 5/1928 | Stokes | 175/257 |
| 2,064,255 | A | 12/1936 | Garfield | |
| 2,148,373 | A * | 2/1939 | Garfield | 175/247 |
| 2,153,815 | A * | 4/1939 | Snyder | 175/247 |
| 2,260,320 | A | 10/1941 | Hoffoss | |
| 2,358,470 | A * | 9/1944 | Norman | 175/77 |
| 2,489,566 | A | 11/1949 | Engle | |
| 2,760,758 | A * | 8/1956 | Yancey et al. | 175/246 |
| 2,829,868 | A * | 4/1958 | Pickard et al. | 175/246 |
| 2,857,138 | A * | 10/1958 | Svendsen et al. | 175/27 |

(Continued)

FOREIGN PATENT DOCUMENTS

| | | |
|---|---|---|
| CA | 2 082 439 | 5/1993 |
| CA | 2223511 | 8/1998 |
| GB | 1 478 127 | 6/1977 |

OTHER PUBLICATIONS

Protest filed Jan. 25, 2010 in corresponding Canadian Patent Application No. 2,655,113.

(Continued)

*Primary Examiner* — Shane Bomar
*Assistant Examiner* — Robert E Fuller
(74) *Attorney, Agent, or Firm* — Morgan, Lewis & Bockius LLP

(57) ABSTRACT

A locking mechanism for locking an insertable device relative to an outer tube of a ground drill comprises at least one latch, which is arranged to releasably retain the insertable device in a substantially fixed axial position relative to the outer tube. The locking mechanism comprises a cam and a cam follower, which are arranged to control a radial position of the latch. The locking system may be used in a ground drill system.

31 Claims, 7 Drawing Sheets

(56) References Cited

U.S. PATENT DOCUMENTS

| | | | | | |
|---|---|---|---|---|---|
| 3,050,143 | A | * | 8/1962 | Kammerer et al. | 175/261 |
| 3,097,708 | A | * | 7/1963 | Kammerer et al. | 175/260 |
| 3,127,943 | A | * | 4/1964 | Takeshi | 175/246 |
| 3,485,310 | A | * | 12/1969 | Milosevich | 175/246 |
| 3,667,558 | A | | 6/1972 | Lambot | |
| 3,977,482 | A | * | 8/1976 | Reed et al. | 175/246 |
| 4,187,919 | A | * | 2/1980 | Lambot | 175/246 |
| 4,800,969 | A | * | 1/1989 | Thompson | 175/246 |
| 5,954,146 | A | | 9/1999 | McLeod et al. | |

OTHER PUBLICATIONS

Search report / opinion on patentability dated Nov. 24, 2009 (in Swedish language).

Protest filed Dec. 24, 2010 in corresponding Canadian Patent Application No. 2,655,113, 41 pages.

Diamant Boart Catalogue entitled "Thin Wall Wire Line Core Barrels Spare Parts," Feb. 1984, 2 pages.

* cited by examiner

LOCKING MECHANISM FOR A GROUND DRILL

RELATED APPLICATION DATA

This application is a §371 National Stage Application of PCT International Application No. PCT/SE2009/050163 filed Feb. 17, 2009, and also claims priority under 35 U.S.C. §119 and/or §365 to Swedish Application No. 0800446-7, filed Feb. 26, 2008.

TECHNICAL FIELD

The present invention relates to a locking mechanism for locking an insertable device in a predetermined position relative to an outer tube of a ground drill. The invention also relates to a ground drill system comprising such a locking mechanism, to a method for locking an insertable device in an outer tube of a ground drill and to a method for retracting an insertable device from an outer tube of a ground drill.

BACKGROUND

In drilling applications today, a drill bit attached to the end of an extendable drill string can drill thousands of meters into the earth. There are several designs of mechanisms used today in drilling applications that allow the inner part of a drill string to be withdrawn from the hole using a wire and overshot, while the outer drill string stays in situ, thereby eliminating the need to withdraw the outer drill string each time a sample is taken. The method is commonly known as wire line drilling and is used as a method to retrieve rock samples, allow hole surveys or in some instances to change the type of drill bit. Using this method it is possible to drill downwards, upwards or horizontally.

Once the sample has been extracted the inner tube assembly is lowered/dropped or pumped back into the hole until it seats against a landing site, which may be a locating shoulder in the outer drill string. This locates the inner tube assembly in one direction axially. To locate the inner tube assembly in the other direction a set of latches may expand out from the inner tube assembly and shoulder a part of the outer drill string to prevent movement in the other direction. During the drilling process these latches are under load as the sample is pushed into the inner tube assembly.

When the inner tube assembly needs to be withdrawn an overshot member is lowered/pumped from the surface and locks itself to a barbed gripper or so called spearhead connected to the inner tube assembly. As load is taken by a wire line cable, the latches may be mechanically withdrawn, which releases the inner tube assembly and thereby allows it to be withdrawn from the outer drill string.

As stated above during drilling these latches take considerable load and under some drilling conditions they are forced tightly against e.g. a seating shoulder in the outer drill string and hence require a lot of force to retract them.

CA 2 223 511 discloses a core barrel apparatus with a wire line core barrel inner tube, having a main body portion of a latch body and an inner portion threaded together, where the latches are seatable in a drill string latch seat. The latches are connected via toggle links to a retractor pin, which in turn is retained within opposed apertures in a latch retractor tube. When the inner tube needs to be retracted, e.g. for retrieving core samples, an overshot member engages a spearhead, which is connected to the latch retractor tube. By an initial retraction of the overshot member, the retractor pin is moved outwardly without exerting radial outward forces through link pins, which are connected to the toggle links. Further retraction of the overshot member causes the retraction pin to move relative to link slots so that the link pins are moved outwardly and radially to pivot the latches out of the latch seat. Even further retraction of the retraction tube retracts the latch body completely.

A great initial axial force is required to release and retract the latches in the above disclosed core barrel apparatus.

U.S. Pat. No. 5,954,146 discloses a latch arrangement in a drill bit system, where a pair of latch dogs pivot about a pivot pin. A spring connects opposite ends of the latch dogs to a pin, which is able to move in a slot. When retrieving the latch dogs the pin is retracted and the spring retracts the ends of the latches.

Also with this arrangement the initial force required to release and retract the latches is great.

GB 1478127 discloses a locking mechanism, wherein the latches present a pair of substantially straight longitudinal edges, and present a cam groove, a withdrawal surface of which is straight and parallel with the longitudinal edges.

U.S. Pat. No. 3,667,558 discloses a locking mechanism, wherein the latches present a pair of longitudinal edges, and wherein a cam groove having a withdrawal surface with a ridge which will counteract a return movement of the cam follower.

There is hence a need for a latch arrangement that improves the initial leverage, i.e. reduces the forces taken up by the latches during retraction of the inner tube assembly.

SUMMARY

It is an object of the present disclosure, to provide a latch arrangement for a wire line core drill, which eliminates or alleviates at least some of the disadvantages of the prior art.

More specific objects include providing a latch arrangement, which allows improved mechanical leverage also gives the possibility to adjust the movement and retracting force on the latches.

The invention is defined by the appended independent claims. Embodiments are set forth in the appended dependent claims and in the following description and drawings.

According to a first aspect, there is provided a locking mechanism for locking an insertable device relative to an outer tube of a ground drill, the locking mechanism comprising at least one latch, which is arranged to releasably retain the insertable device in a substantially fixed axial position relative to the outer tube, wherein the locking mechanism comprises a cam and a cam follower, which are arranged to control a radial position of the latch, or of a part thereof. The latch is provided, at a first longitudinal edge thereof, with an engagement surface adapted to engage a latch seat, and also presents a second longitudinal edge, opposite the first longitudinal edge. The latch is pivotable about a pivot axis at a first end of the latch, and the cam is arranged at an axially substantially opposite second end of the latch. The cam presents a withdrawal surface, against which a cam follower is arranged to slide to cause the latch to withdraw to unlock the insertable device from the outer tube, the withdrawal surface extending from a proximal portion of the cam to a distal portion of the cam, and the cam follower is movable along the withdrawal surface from a first end of the cam, closest to the pivot axis to a second end of the cam, farthest away from the pivot axis. The withdrawal surface at the second end of the cam is closer to the first longitudinal edge than at any other point along the cam.

By "insertable device" is meant a device which may comprise e.g. one or more of a so called inner tube assembly, drill bit segments, a drill bit segment carrier, an overshot member, etc.

By "ground drill" is meant any type of drill which is used for drilling into the ground, e.g. a wire line core drill for retrieving rock samples, where an outer tube is inserted into the drill hole and where an insertable device, e.g. an inner tube assembly, is inserted into the outer tube.

By the insertable device being slidable is meant that it can be retracted from, i.e. pulled out of, the outer tube.

By this locking mechanism there is provided a way in which the insertable device more easily can be retracted from the outer tube, i.e. the latches may more easily be moved from an expanded locking position to a collapsed or retracted position.

The design of the withdrawal surface provides for reliable operation and favourable leverage where needed.

The cam and the cam follower may be arranged such that a maximum value of a ratio between a transverse force, acting to move the latch from the locking position, and an axial force, acting to move the insertable device axially relative to the outer tube, is obtained at or near a beginning of a substantially axial movement between the cam and the cam follower.

The withdrawal surface, at the first end of the cam, may be closer to the second longitudinal edge than at the second end of the cam.

The withdrawal surface, at the first end of the cam, may be closer to the second longitudinal edge than at any other point along the cam.

By arranging the cam and cam follower of the locking mechanism in this manner there may be provided a way of more easily retracting the insertable device when it has been locked in its position in the outer tube, since the forces required to break the friction, in order to move the latches from the locking position, may initially be greater. This optimization of the forces required for the retraction of the latches may also reduce the risk of the latches being damaged during the move from an expanded locking position to a retracted position.

The cam may be formed on the latch and it may be at least partially formed as a slot, a groove, a lip or an edge. The cam may wholly or partially be curved.

The cam follower may comprise a pin, which is moveable in contact with the cam.

By having a cam follower pin which is moveable in a curved cam slot there is provided a way of, with reduced axial force, to transversely move the latches from a locking position in the outer tube. The movement of the latches may also be more controlled by this arrangement.

The cam may be at least partially formed as a slot or a groove, having a width that varies along the withdrawal surface. With a width that varies, it is possible to enable the latches to move individually. If the latches are designed to move individually, one of the latches may be properly activated even though the other one is jammed. A specifically advantageous embodiment may be where the cam slot allows the cam follower to move both along the withdrawal surface and in a direction away from the withdrawal surface. For example, the cam groove may be formed as a substantially triangular recess or substantially a segment of a circle. The curved cam slot may also provide flexibility in the design of latches, by adjusting the profile of the cam slot an optimum leverage may be obtained to fit a specific latch design.

As an alternative, the cam may be substantially straight.

The cam follower may be attached to a sliding case, which is axially movable relative to a latch body in response to an axial force being applied to the sliding case. The sliding case may be connected to a spearhead point.

By this arrangement, there may be provided an easy and secure way of moving the latches from a locking position, by pulling the spearhead point axially out of the outer tube and thereby retracting the insertable device. The arrangement allows for a transference of forces where an initial axial force, i.e. pulling the spearhead point and sliding case out of the outer tube, is translated into a transverse force, i.e. retracting the latches from an expanded locking position by the interaction of the cam and cam follower.

The latch may be pivotable relative to a latch body and pivotable relative to a transverse axis.

By the latch being pivotable there is provided a way of moving the latches relative to the latch body in a secure and controlled manner, since the movement thereof is controlled by the trajectory the latches must follow.

The transverse axis and the cam may be positioned substantially at axially opposite ends of the latch.

By positioning the latches at axially opposite ends there may be provided even better means for locking the insertable device in its position in the outer tube, since the latches may be expanded to uniformly distribute the load.

The latches may be biased towards the locking position. By this biasing the latches may more easily be brought to an expanded locking position. The expansion of the latches may be aided by, e.g. a spring arranged on top of the latches.

The locking mechanism may comprise at least two latches and the latches may be arranged to operate in substantially opposite directions. By this arrangement the latches may be expanded to uniformly distribute the load and hence to be able to lock the insertable device in a more secure manner.

The latch may further comprise a spring pocket, adapted for receiving part of a spring. The spring pocket may comprise a recess in a body of the latch.

According to a second aspect, there is provided a ground drill system wherein the insertable device may be lockable in a predetermined position in the outer tube by a locking mechanism according to the first aspect of the present solution.

By this ground drill system there may be provided a system in which the insertable device may easily be locked in position and retrieved from the locking position without the need for excessive axial forces to move the locking mechanism from the locking position.

The outer drill tube may be provided with a latch seat lip. The latch seat lip may be arranged at one end of a locking coupling. The latch may be adapted for engagement with the latch seat lip. By engaging the latch of the locking mechanism with the latch seat lip there may be provided a way to secure the position of the latches and hence the insertable device and also a way to control the maximum expansion of the latches.

The outer drill tube may be provided with a landing member adapted to receive the insertable device.

The landing member may aid in the axial positioning of the insertable device in the outer tube.

The insertable device may comprise an inner tube.

BRIEF DESCRIPTION OF THE DRAWINGS

Embodiments of the present solution will now be described, by way of example, with reference to the accompanying schematic drawings.

DESCRIPTION OF EMBODIMENTS

In the following description the expression "axial" refer to a direction substantially longitudinal to the line II-II of FIG. 2

The expressions "transverse" and "transversal" refer to a direction essentially perpendicular to the "axial" direction.

Figure 1:
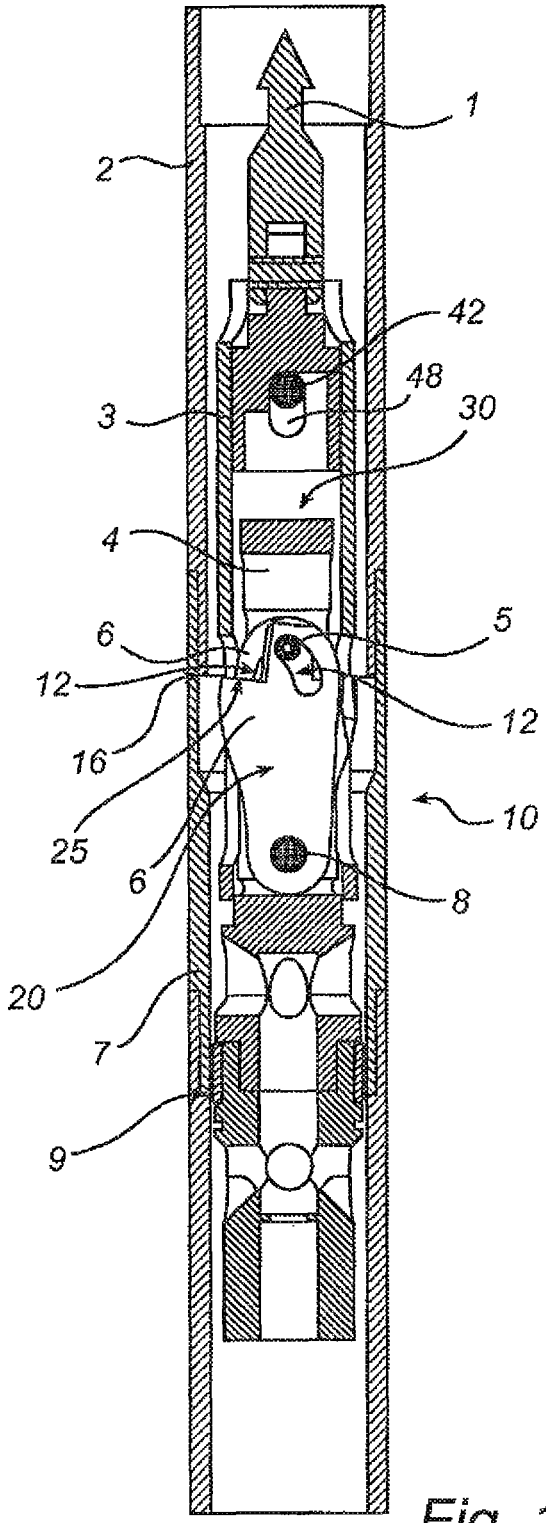
FIG. 1 is a schematic sectional view of an outer drill string where the latch arrangement is in a retracted position in the drill string.
Figure 2:
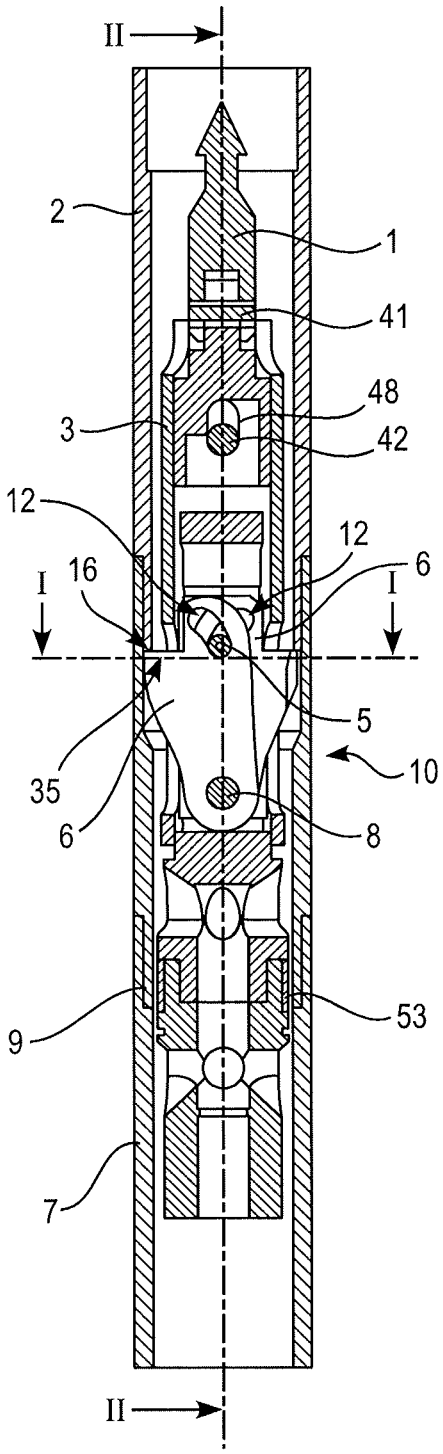
FIG. 2 is a schematic sectional view of an outer drill string where the latch arrangement is in an expanded position in the drill string.

FIGS. 1 and 2 illustrate a ground drill system with and outer drill string 10, wherein an insertable device 30 may be inserted and positioned at a predetermined position in the outer tube 10. The insertable device 30 may e.g. comprise a barbed gripper, such as a spearhead point 1, a sliding case 3, an inner tube (not shown) and a locking mechanism 20. The insertable device 30 may also comprise other, not shown or described herein, parts and components meant for insertion into an outer tube of a ground drill system.

The locking mechanism 20 comprises a latch body 4 having at least one latch 6 mounted thereon. According to one embodiment, the latch body may comprise at least two latches 6 (see FIGS. 3*a*, 3*b* and 4). The locking mechanism 20 comprises a cam 12 and a cam follower 5.

The outer tube 10 of the ground drill system may comprise a locking coupling 2 and an adaptor coupling 7. The engagement of the locking coupling 2 and the adaptor coupling may create a latch seat 16. The latch seat 16 may be an abutment, a recess or a lip. The latch seat 16 may be adapted to engage the latch 6, when the latch 6 is in an expanded position 35 (FIG. 2, 3*b*).

The outer tube 10 may present a landing shoulder, which may have the form of a landing ring 9. The landing ring 9 may be adapted to receive and position the insertable device 30 in the outer tube. The landing ring 9 may be a recess, a lip or a groove in the outer tube 10.

The insertable device 30 may comprise a sliding case 3. The sliding case 3 may be connected to a spearhead point 1. The spearhead point 1 may be engageable with an overshot member (not shown) for retrieval of the insertable device 30 from the outer tube 10.

Figure 3B:
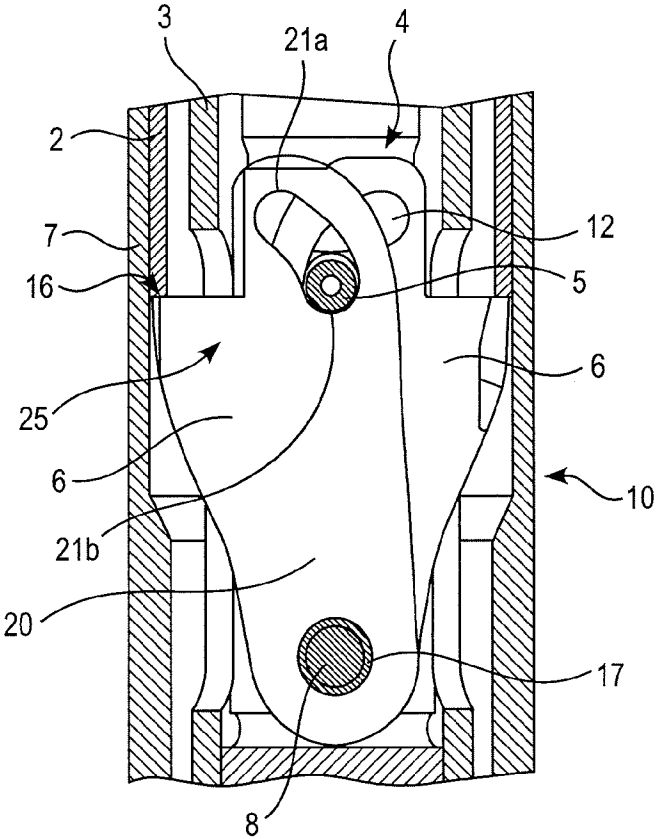
FIGS. 3*a* and 3*b* are schematic sectional detailed views of a pair of latches in a retracted and expanded position respectively.
Figure 3A:
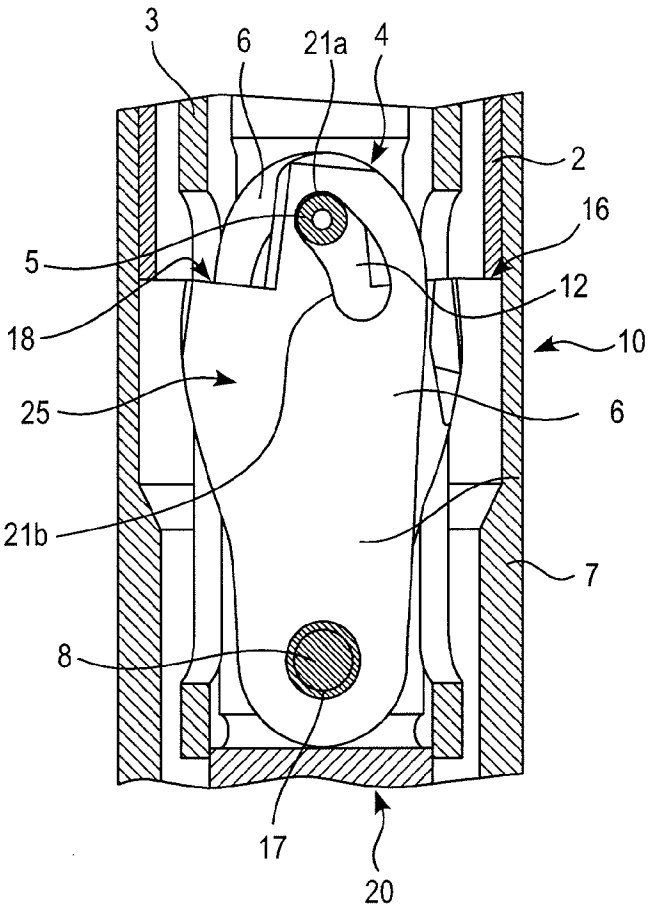

FIGS. 1 and 3*a* illustrate a retracted position 25 of the locking mechanism 20. According to one embodiment, the latches 6 do not engage the latch seat 16 in the retracted position 25.

FIGS. 2 and 3*b* illustrate an expanded locking position 35 of the locking mechanism 20. In the locking position 35, the latches 6 may be expanded to engage the latch seat lip 16.

FIGS. 3*a* and 3*b* illustrate the locking mechanism 20 in more detail.

A cam 12 may be formed on the latch 6.

The cam may, according to alternative embodiments be a slot, a groove, a lip or an edge, and may be formed in/on the latch or in/on the latch body. The cam may also comprise combinations thereof, e.g. partially a groove and partially a slot.

The cam 12 may, according to one embodiment shown in the FIGS. 3*a* and 3*b*, be a curved slot, which may either transverse the body of the latch 6, or be formed as a groove in the body of the latch.

The cam follower 5 may, according to one embodiment be a pin, which may be moveable in the cam 12. According to one embodiment, the cam follower 5 may be adapted to be moveable in a curved slot formed in the latch. The cam follower 5 may, according to not shown, alternative embodiments have any design suitable for interaction with the cam 12.

The cam 12 may be formed such that the movement of the cam follower 5 in an axial direction moves an upper portion of the latches in a substantially transverse direction, i.e. expanding the latches to engage the latch seat lip 16 or retracting them from the locking position 35 to a closed or retracted position 25. The cams 12 may even be formed such that the latches, if more than one, may operate in substantially opposite directions.

The cam 12 may be adapted in size and length to achieve optimum movement of the latches 6.

The latch or latches 6 may present an engagement surface 18 adapted to engage a latch seat 16. The engagement surface 18 may comprise a groove, a lip or an edge.

The locking mechanism 20 may comprise a pivot axis 8. The pivot axis 8 may be formed as a pivot pin arranged in a recess or hole 17 in the latch 6. The pivot axis 8 and the cam 12 may be positioned at axially substantially opposite ends of the latch 6. The pivot axis may be fixedly connected to the latch body 4, e.g. by extending through the latch body. The pivot axis 8 may be a pin, arranged to allow for the latch 6 to be pivotable relative to a transverse axis of the latch body 4 (FIG. 5).

Figure 4:
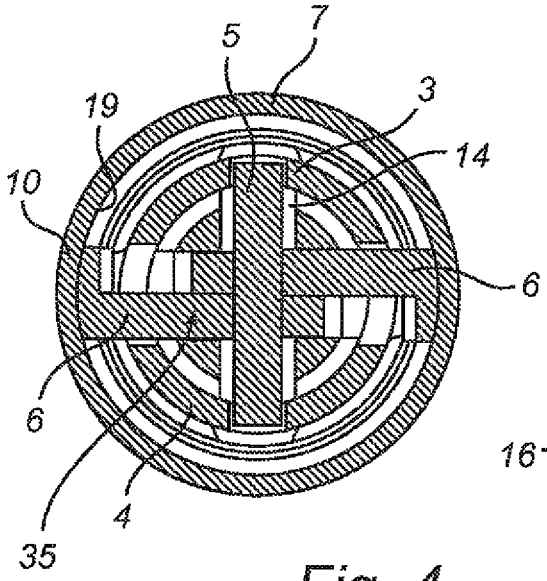
FIG. 4 is a schematic cross sectional view along the line I-I of FIG. 2.
Figure 5:
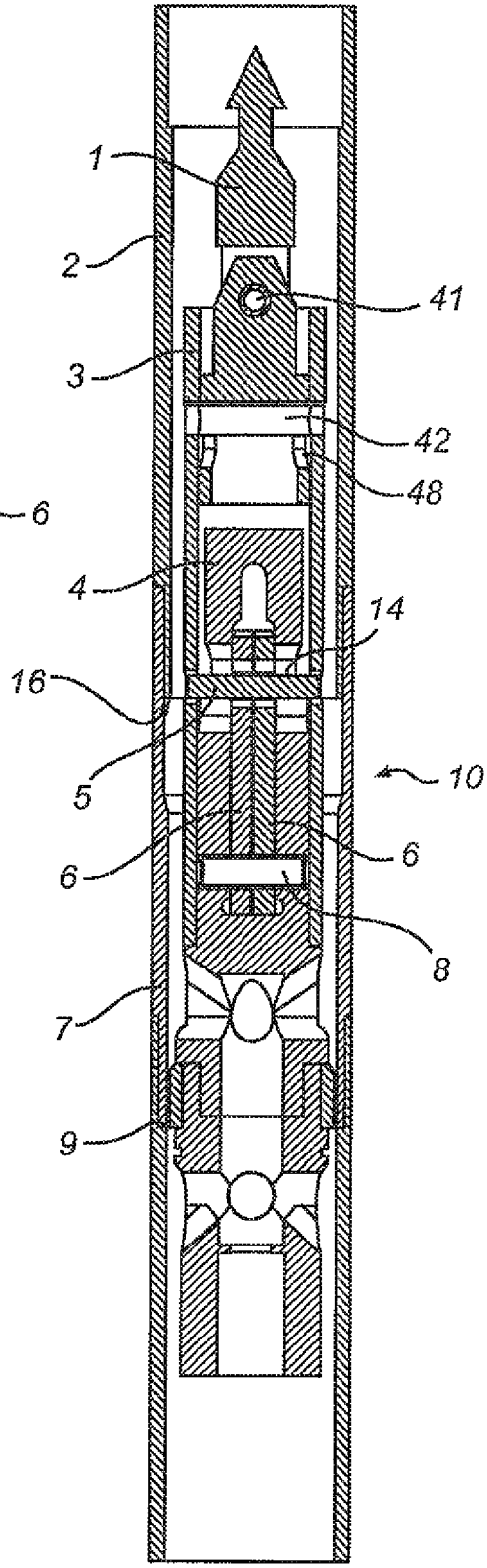
FIG. 5 is a schematic cross sectional view along the line II-II of FIG. 2.

FIGS. 4 and 5 illustrate the cam follower's 5 connection to the sliding case 3. The cam follower may be fixedly connected to the sliding case 3. The cam follower may, according to an alternative, be moveable in e.g. a slot or groove provided in the sliding case 3.

FIG. 4 illustrates that the latch body 4 may comprise a slot 14. The cam follower 5 may extend through the latch body slot 14. The axial movement of the cam follower 5 may be controlled by the length of the cam 12 and of the slot 14, whereby also the axial movement of the sliding case 3 relative to the latch body 4 can be controlled and limited. By controlling the axial movement of the cam follower 5, the extent of the expansion of the latches 6 may also be controlled and limited.

FIG. 4 further illustrates that the latches 6 may be arranged to expand substantially radially, as seen in a cross section of the device, taken along line I-I in FIG. 2, to a locking position 35 and may hence bear against or arrive at close proximity to the inner wall 19 of the outer tube 10.

The latches 6 may be biased towards the locking position 35. The biasing of the latches may be provided by a spring (not shown), which may be arranged at one side of the cam follower 5.

FIGS. 7*a*-7*g* provide more detailed views of the parts forming the insertable device.

Figure 7A:
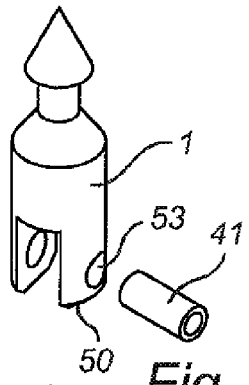
FIGS. 7*a*-7*g* are schematic exploded views of an insertable device.
Figure 7B:
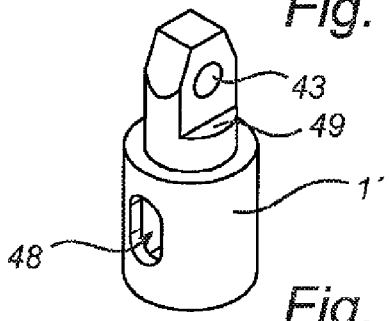

FIGS. 7*a* and 7*b* illustrate the spearhead 1, which in one embodiment may be formed from two portions 1 and 1'. The first portion 1 may be positioned on top of the second portion 1' by a landing lip 49, which may engage an abutment 50 of the first portion 1. The first portion 1 may be locked to the second portion 1' by a pin 41, which may be inserted through holes 53 and 43. The second portion 1' may also be formed to fit the first portion 1 e.g. as a male and female connector.

Figure 7C:
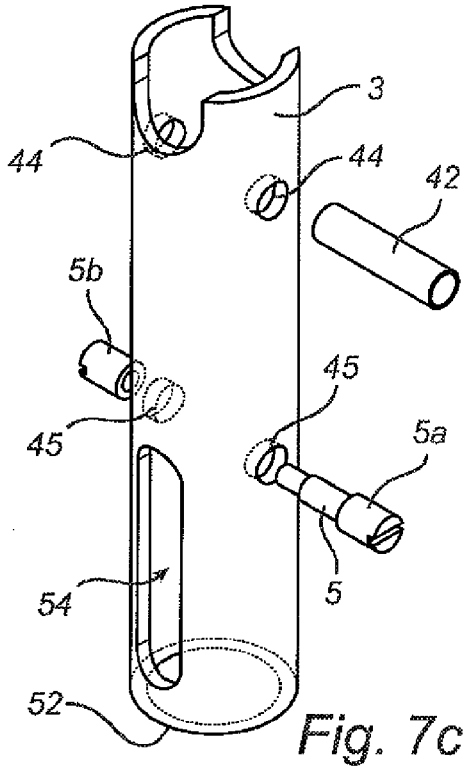
Figure 7D:
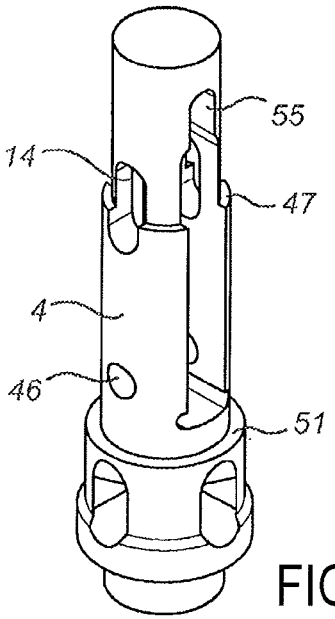

FIG. 7*c* illustrates the sliding case 3. The second portion 1' of the spearhead may engage the sliding case 3 and be locked in position by a pin 42, engaging the openings 44 and 48 of the sliding case and spearhead respectively. One of the openings 44 and 48 may be formed as a slot, so as to allow for some relative axial movement between the sliding case and the spearhead. In the illustrated example, it is the opening 48 of the sliding case that is formed as a slot.

A pair of latches 6 (FIG. 7*e*) may, according to one embodiment, be arranged in a latch receiving slot 55 of the latch body 4 (FIG. 7*d*), such that the pivot axis 8 may be arranged in a holes 46 in the latch body 4, and in a corresponding hole 17 in each of the latches.

The sliding case 3 may be arranged to substantially enclose the latch body 4. One end 52 of the sliding case may be arranged to abut a landing ring 51 of the latch body. The latch body 4, carrying the latches 6, may be arranged such that the latches are expandable through an opening 54 in the sliding case 3.

The cam follower 5 may be arranged in a hole 45 in the sliding case 3 so as to engage the cam 12 in the latch 6. The cam follower 5 may be fixed to the sliding case 3 by e.g. a nut and bolt connection 5*a*, 5*b*, such that the cam follower 5 is fixed relative to the sliding case 3. The cam follower 5 may further be arranged in a substantially axial slot 14 in the latch body, such that the cam follower is axially movable relative to the latch body.

Figure 7F:
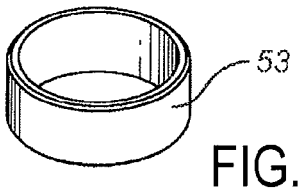
Figure 7E:
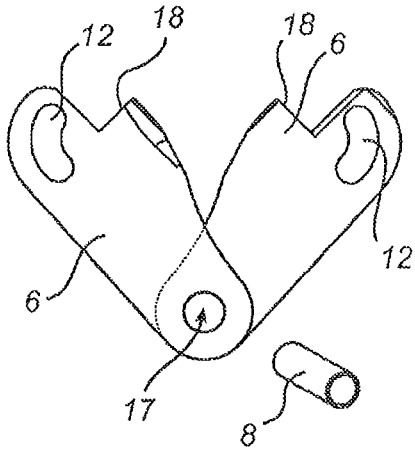
Figure 7G:
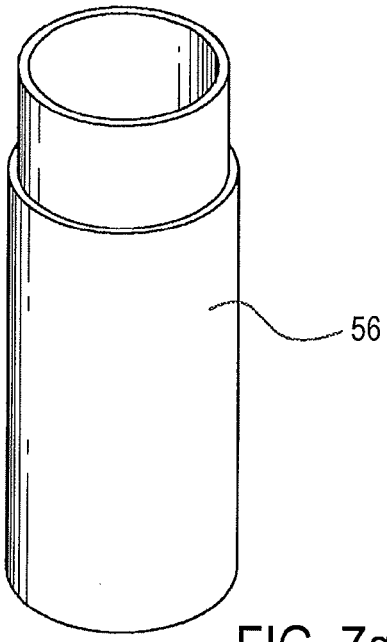

A bushing 53 may be arranged to connect the latch body 4 with e.g. an end portion 56 of the insertable device 30 (FIGS. 7*f* and 7*g*).

The insertion of the insertable device 30 into the outer tube 10 will now be described.

A general method of inserting the insertable device 30 into an outer tube 10 of a ground drill, not shown in the figures, may be performed by simply lowering or pumping the insertable device into the outer tube 10, in a per se known manner. The locking mechanism 20 may be connected to the insertable device 30 in connection with the insertable device 30 being inserted into the outer tube. The insertable device 30 may e.g. comprise a spearhead point, a sliding case, a locking mechanism and it may be connected to an inner tube. During the lowering/insertion of the insertable device 30, the latches 6 of the locking mechanism 20 may be in a contracted position 25 (FIG. 1). The latches may also be outwardly biased, as mentioned above.

Referring now to FIG. 1, the correct axial position of the insertable device 30 may be limited in one direction by the landing ring 9, which may be provided in the outer tube 10 and which is adapted to receive the insertable device 30.

To position the insertable device 30 in a transversal direction, the locking mechanism 20 may be utilised. Once the insertable device 30 has reached the landing ring and thus has been positioned in the axial direction, the latches 6 may be further expanded into a locking position 35 by the axial movement of the sliding case 3. The axial movement of the sliding case 3 may, according to one embodiment, actuate an axial movement of the cam follower 12. The cam follower 5 may subsequently force the latches 6 outwardly by the interaction with the cam 12, such that the latches 6 reach the locking position.

In the locking position, the latches 6 are in an expanded state such that an engagement surface 18 of the respective latch 6 engages a latch seat 16 (FIG. 2, FIG. 3*b*). The landing of the insertable device 30 against the landing ring 9 may allow for a further axial movement of the sliding case 3, e.g. by influence of the weight of the spearhead point 1, or merely by its own weight. The spearhead point 1 may also be pushed into the outer tube 10 by engagement with e.g. an overshot member (not shown) and hence move the sliding case axially.

The latches 6 may be arranged on the latch body 4 such that they are folded in substantially radially opposite directions (see FIGS. 3*b* and 4). The manner in which the latches 6 may be folded may be controlled by the design and position of the cam 12. The cam 12 may, according to one embodiment, be formed as a curved slot (see FIG. 3*b*) and positioned on the latch 6 such that an axial movement of the cam follower, which is arranged to be moveable in the cam slot, may cause the latches 6 to fold in substantially radially opposite directions or, when the insertable device 30 is to be retracted, folded inwardly.

The retraction of the insertable device 30 from the outer tube of a ground drill will now be described.

A general method for retraction of an insertable device 30, which is not shown in the figures, may be performed by inserting an overshot member into the outer tube 10. The overshot member may e.g. be pumped or dropped into the outer tube. The overshot member may then engage and connect to, in a per se known manner, the spearhead point 1 shown in FIGS. 2 and 5. By applying a tensile force to the overshot member, e.g. through a wire connected to the overshot member, it may be pulled out of the outer tube 10 from the outside, and hence be caused move axially relative to the outer tube 10.

The axial movement of the overshot member out of the outer tube may be transferred to the sliding case 3 by the subsequent axial movement of the spearhead point 1. Hence the sliding case 3 may be rendered to slide relative to the latch body 4.

The axial movement of the sliding case 3 may be transferred to the cam follower 5, by the fixed connection of the cam follower 5 to the sliding case 4 (see FIG. 4) at 45. The sliding case 3 may also, according to an alternative embodiment, engage the cam 12 (not shown). The axial movement of the cam follower 5 may, in turn, be at least partially translated into a large substantially radial force for retracting the latch 6. The latch 6 may hence disengage the latch seat 16 and be withdrawn from the locking position 35. By withdrawing the latches, they are folded inwardly, into the latch body. The cam follower 5 may, according to one embodiment, further be arranged in a slot 14 in the latch body (see FIG. 4), by the connection of the cam follower to the sliding case 3 the axial movement of the latter, relative to the latch body, may be limited.

The axial movement of the sliding case 3 may, according to one embodiment, further be limited by a slot 14 in the latch body 4. Hence, the load on the sliding case may be transferred through the earn follower 5 to the latch body 4, to reduce, or eliminate, the load taken up by the latches 6.

When the latches have reached the contracted position 25 (FIGS. 1 and 3*a*), the insertable device 30 may be slidable relative to the outer tube 10 and may hence be pulled out of the ground drill system, by the overshot member and wire.

Figure 6:
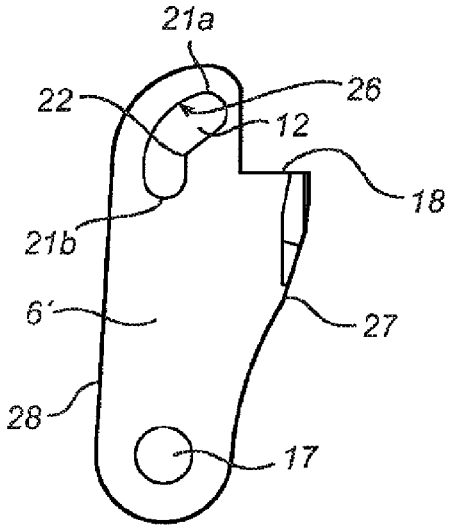
FIG. 6 is a schematic sectional detailed view of a latch, according to another embodiment.

FIG. 6 illustrates an alternative embodiment of a latch 6' having a cam 12, wherein an upper profile of the cam is substantially the same as in FIGS. 3*a*-3*b*, and in which a first portion 21*a* of the cam 12 is designed to essentially mirror a second portion 21*b*, in order to reduce the risk of the latch being stuck in the closed position 25.

FIG. 6 illustrates further parts of the cam, such as the first and second longitudinal edges 27, 28 and the withdrawal surface 26.

The profile of the cam 12 may also be provided with a detent 22. The detent 22 may be provided to reduce the risk of the latches 6 disengaging the latch seat 16 in the expanded position 35. The second portion 21*b* of the cam may be designed as to allow for an excessive movement axially of the cam follower 5 in order to reduce the risk of the latches not being opened properly due to e.g. debris caught on the cam follower or in the cam.

The cam 12 may be arranged on the latch 6 such that the slot, groove, lip or edge is substantially exaggerated in relation to the actual length needed for the optimized axial movement of the cam follower. By "optimized axial movement" of the cam follower is meant the length needed in order to move the latches from a open position to a closed position. Hence, the latches may be prevented from carrying any load in the axial direction.

Figure 8A:
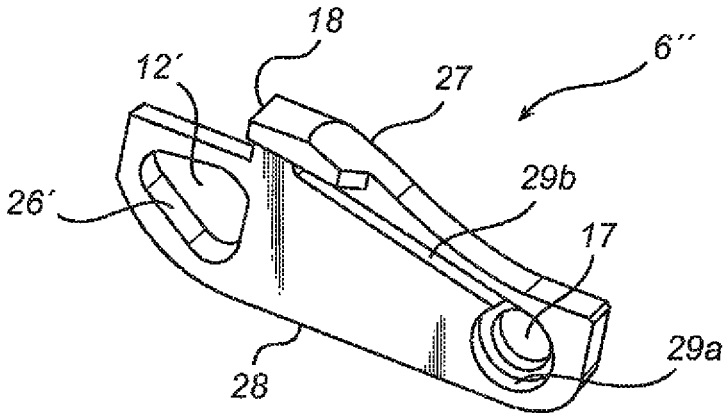
FIGS. 8*a*-8*b* schematically illustrate another embodiment of a latch.
Figure 8B:
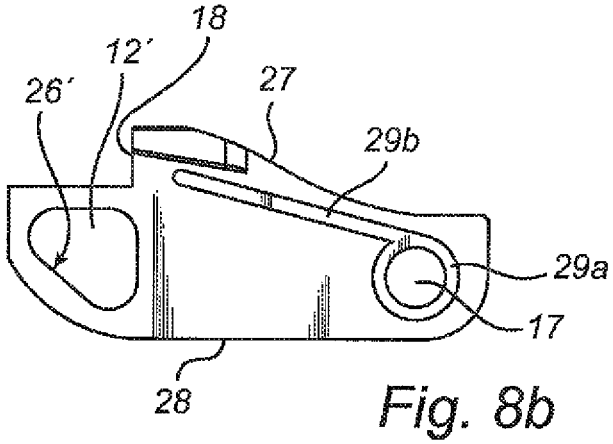

Referring to FIGS. 8*a* and 8*b*, another embodiment of the latches 6" is described. In this embodiment, the cam recess 12' has a width that varies along the withdrawal surface 26', and a substantially straight withdrawal surface. The cam recess 12' may be substantially triangular in shape. The cam recess may extend through the entire thickness of the latch, thus forming a slot, or it may extend partially through the thickness of the latch, thus forming a groove of varying width.

Furthermore, the cam recess may be positioned close to an end portion of the latch. In one embodiment, it may be positioned as closely to the end portion of the latch as possible, with due regard to the strength requirements to which the latch is subjected. In either of the above disclosed embodiments, a spring pocket 29*a*, 29*b* may be provided in the latch body. The spring pocket may be formed as a partial widening 29*a* of the pin hole 17, connected to an elongate groove 29*b*, which is sized and adapted to receive an abutment portion of the spring.

The invention claimed is:

1. A locking mechanism for locking an insertable device relative to an outer tube of a ground drill, the locking mechanism comprising:

at least one latch, which is arranged to releasably retain the insertable device in a substantially fixed axial position relative to the outer tube, wherein the locking mechanism comprises a cam and a cam follower, which are arranged to control a radial position of the latch, the latch being provided, at a first longitudinal edge thereof, with an engagement surface adapted to engage a latch seat, and presenting a second longitudinal edge, opposite said first longitudinal edge, the latch being pivotable about a pivot axis at a first axial end of the latch, and the cam being arranged at an axially substantially opposite second axial end of the latch, wherein the cam presents a withdrawal surface, against which the cam follower is arranged to slide to cause the latch to withdraw to unlock the insertable device from the outer tube, the withdrawal surface extending from a first end of the cam to a second end of the cam, wherein the cam follower is movable along the withdrawal surface from the first end of the cam, closest to the pivot axis, to the second end of the cam, farthest away from the pivot axis, wherein the withdrawal surface at the second end of the cam is closer to the first longitudinal edge than at any other point along the cam, and wherein the withdrawal surface is continuously curved between the first end of the cam and the second end of the cam.

2. The locking mechanism as claimed in claim 1, wherein the withdrawal surface, at the first end of the cam, is closer to the second longitudinal edge than at the second end of the cam.

3. The locking mechanism as claimed in claim 1, wherein the withdrawal surface, at the first end of the cam, is closer to the second longitudinal edge than at any other point along the cam.

4. The locking mechanism as claimed in claim 1, wherein the cam and the cam follower are arranged such that a maximum value of a ratio between:

a substantially transverse force, acting to move the latch from the locking position, and a substantially axial force, acting to move the insertable device axially relative to the outer tube, is obtained at or near a beginning of a substantially axial movement between the cam and the cam follower.

5. The locking mechanism as claimed in claim 1, wherein the cam is at least partially formed as a slot, a groove, a lip or an edge.

6. The locking mechanism as claimed in claim 5, wherein the cam is at least partially formed as a slot or a groove, having a width that varies along the withdrawal surface.

7. The locking mechanism as claimed in claim 1, wherein the cam follower comprises a pin, which is moveable in contact with the cam.

8. The locking mechanism as claimed in claim 1, wherein the cam follower is attached to a sliding case, which is axially movable relative to a latch body in response to an axial force being applied to the sliding case.

9. The locking mechanism as claimed in claim 8, wherein the sliding case is connected to a spearhead point.

10. The locking mechanism as claimed in claim 9, wherein the latch is pivotable relative to a transverse axis.

11. The locking mechanism as claimed in claim 1, wherein the latch is pivotable relative to a latch body.

12. The locking mechanism as claimed in claim 1, wherein the latch is biased towards a locking position.

13. The locking mechanism as claimed in claim 1, comprising at least two latches.

14. The locking mechanism as claimed in claim 13, wherein the latches are arranged to operate in substantially opposite directions.

15. The locking mechanism as claimed in claim 1, wherein the latch further comprises a spring pocket, adapted for receiving part of a spring.

16. The locking mechanism as claimed in claim 15, wherein the spring pocket comprises a recess in a body of the latch.

17. The locking mechanism as claimed in claim 1, wherein the engagement surface of the latch is axially positioned between the first end of the cam and the second end of the cam.

18. The locking mechanism as claimed in claim 1, wherein the engagement surface is closer to the first end of the cam than to the second end of the cam.

19. The locking mechanism as claimed in claim 1, wherein a circumference of the cam is substantially triangular in shape.

20. A ground drill system comprising the locking mechanism as claimed in claim 1, wherein the locking mechanism locks the insertable device relative to the outer tube of a ground drill in a predetermined position in the outer tube.

21. The ground drill system as claimed in claim 20, wherein the outer tube is provided with a latch seat.

22. The ground drill system as claimed in claim 21, wherein the latch seat is arranged at one end of a locking coupling.

23. The ground drill system as claimed in claim 21, wherein the latch is adapted for engagement with the latch seat.

24. The ground drill system as claimed in claim 20, wherein the outer tube is provided with a landing member adapted to receive the insertable device.

25. The ground drill system as claimed in claim 20, wherein the insertable device comprises an inner tube.

26. A locking mechanism for locking an insertable device relative to an outer tube of a ground drill, the locking mechanism comprising:

at least one latch, which is arranged to releasably retain the insertable device in a substantially fixed axial position relative to the outer tube, wherein the locking mechanism comprises a cam and a cam follower, which are arranged to control a radial position of the latch, the latch being provided, at a first longitudinal edge thereof, with an engagement surface adapted to engage a latch seat, and presenting a second longitudinal edge, opposite said first longitudinal edge, the latch being pivotable about a pivot axis at a first axial end of the latch, and the cam being arranged at an axially substantially opposite second axial end of the latch, wherein the cam presents a withdrawal surface, against which the cam follower is arranged to slide to cause the latch to withdraw to unlock the insertable device from the outer tube, the withdrawal surface extending from a first end of the cam, closest to the pivot axis, to a second end of the cam, farthest away from the pivot axis, wherein the cam follower is movable along the withdrawal surface from the first end of the cam to the second end of the cam, wherein the withdrawal surface at the second end of the cam is closer, in the transverse direction, to the first longitudinal edge than at any other point along the cam, and wherein the withdrawal surface at the second end of the cam is further away, in the axial direction, from the pivot axis than the engagement surface.

27. The locking mechanism as claimed in claim 26, wherein a majority of the length of the withdrawal surface of the cam is further away, in the axial direction, from the pivot axis than the engagement surface.

28. The locking mechanism as claimed in claim 26, wherein the entire length of the withdrawal surface of the cam is further away, in the axial direction, from the pivot axis than the engagement surface.

29. The locking mechanism as claimed in claim 26, wherein the withdrawal surface is wholly or partially curved between the first end of the cam and the second end of the cam.

30. The locking mechanism as claimed in claim 26, wherein the withdrawal surface extends from the first end of the cam to the second end of the cam in a continuous curve.

31. The locking mechanism as claimed in claim 26, wherein interior peripheral surfaces of the cam are substantially triangular in shape.

* * * * *